US010501828B2

(12) United States Patent
Lee et al.

(10) Patent No.: US 10,501,828 B2
(45) Date of Patent: Dec. 10, 2019

(54) ALUMINUM ALLOY FOR CYLINDER HEAD AND METHOD OF MANUFACTURING THE SAME

(71) Applicants: HYUNDAI MOTOR COMPANY, Seoul (KR); KIA MOTORS CORPORATION, Seoul (KR)

(72) Inventors: Kyung Moon Lee, Uiwang-si (KR); Byung Ho Min, Seoul (KR); Hoo Dam Lee, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 342 days.

(21) Appl. No.: 15/639,162

(22) Filed: Jun. 30, 2017

(65) Prior Publication Data

US 2018/0127853 A1 May 10, 2018

(30) Foreign Application Priority Data

Nov. 10, 2016 (KR) ..... 10-2016-0149648

(51) Int. Cl.

| | |
|---|---|
| ***C22C 21/14*** | (2006.01) |
| ***C22C 21/18*** | (2006.01) |
| ***F02F 1/24*** | (2006.01) |
| ***C22C 1/02*** | (2006.01) |
| ***C22F 1/057*** | (2006.01) |
| ***C22C 21/16*** | (2006.01) |

(52) U.S. Cl.

CPC ..... *C22C 21/14* (2013.01); *C22C 1/026* (2013.01); *C22C 21/16* (2013.01); *C22C 21/18* (2013.01); *C22F 1/057* (2013.01); *C22C 2202/00* (2013.01); *F02F 1/24* (2013.01)

(58) Field of Classification Search

CPC ..... C22C 21/14; C22C 21/16; C22C 21/18; C22C 2202/00; C22C 1/026; C22F 1/057; F02F 1/24

See application file for complete search history.

(56) References Cited

FOREIGN PATENT DOCUMENTS

| | | | |
|---|---|---|---|
| JP | 2005-264301 | A | 9/2005 |
| JP | 2009-13480 | A | 1/2009 |
| JP | 2013-174022 | A | 9/2013 |
| KR | 10-2016-0048234 | A | 5/2016 |

*Primary Examiner* — C Melissa Koslow

(74) *Attorney, Agent, or Firm* — Knobbe Martens Olson & Bear LLP

(57) ABSTRACT

An aluminum alloy for a cylinder head in a vehicle engine includes 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr, the balance of Al, and inevitable impurities, wherein an AlCuMgSi-based crystal is formed in an amount ranging from 0.3 to 0.9% and an $Al_2Cu$-based precipitate is formed in an amount ranging from 3.3 to 4.0%, wherein percentage (%) is based on weight.

6 Claims, 6 Drawing Sheets

ALUMINUM ALLOY FOR CYLINDER HEAD AND METHOD OF MANUFACTURING THE SAME

CROSS-REFERENCE TO RELATED APPLICATION

This application claims the priority benefit of Korean Patent Application No. 10-2016-0149648, filed on Nov. 10, 2016, in the Korean Intellectual Property Office, the disclosure of which is incorporated herein by reference.

BACKGROUND

1. Field

The present disclosure relates to an aluminum alloy for a cylinder head and a method of producing a cylinder head using the same.

2. Description of the Related Art

A cylinder head is a major component of an engine which functions as an inlet of fuels and air, and an outlet of exhaust gas. In general, when explosion occurs in a combustion chamber, a lower surface temperature of the cylinder head increases to about 200° C. When the temperature of the combustion chamber increases, fuels spontaneously combust, thus causing a knocking phenomenon. Such a phenomenon results in problems such as deterioration in engine durability and fuel economy.

In order to prevent this phenomenon in the combustion chamber, heat generated after explosion should be rapidly released to the outside. Accordingly, when a cylinder head is produced from a material with high thermal conductivity, heat transferred from the combustion chamber to the head is emitted to the outside so that a knocking phenomenon can be prevented and fuel costs can thus be reduced.

The disclosure of this section is to provide background of the invention. Applicant notes that this section may contain information available before this application. However, by providing this section, Applicant does not admit that any information contained in this section constitutes prior art.

SUMMARY

An aspect of the present invention provides an aluminum alloy for a cylinder head which is capable of maintaining high thermal conductivity at a high temperature (200° C.) generated during operation of a cylinder and superior strength, and a method of producing a cylinder head using the same.

Another aspect of the present invention provides an aluminum alloy for a cylinder head used in a vehicle engine including 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr, the balance of Al and inevitable impurities, wherein an AlCuMgSi-based crystal is formed in an amount ranging from 0.3 to 0.9% and an $Al_2Cu$-based precipitate is formed in an amount ranging from 3.3 to 4.0%, wherein percentage (%) is based on weight.

The aluminum alloy may have a thermal conductivity at 200° C. of 185 W/mK or more.

The aluminum alloy may have a tensile strength of 270 MPa or more.

The aluminum alloy may have a yield strength of 197 MPa or more and an elongation of 1.6% or more.

Another aspect of the present invention provides a method of producing an aluminum alloy for a cylinder head used in a vehicle engine including casting molten metals including 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr, the balance of Al and inevitable impurities to produce an article in the form of a cylinder head, conducting solid solution treatment on the article and conducting aging heat treatment such that an AlCuMgSi-based crystal is formed in an amount of 0.3 to 0.9% and an $Al_2Cu$-based precipitate is formed in an amount of 3.3 to 4.0%, wherein percentage (%) is based on weight.

The aging heat treatment may be carried out at a heat treatment temperature of 265 to 275° C. for 2 to 3 hours.

BRIEF DESCRIPTION OF THE DRAWINGS

The above and other features and other advantages of the present invention will be more clearly understood from the following detailed description taken in conjunction with the accompanying drawings, in which.

DETAILED DESCRIPTION OF EMBODIMENTS

Figure 1:
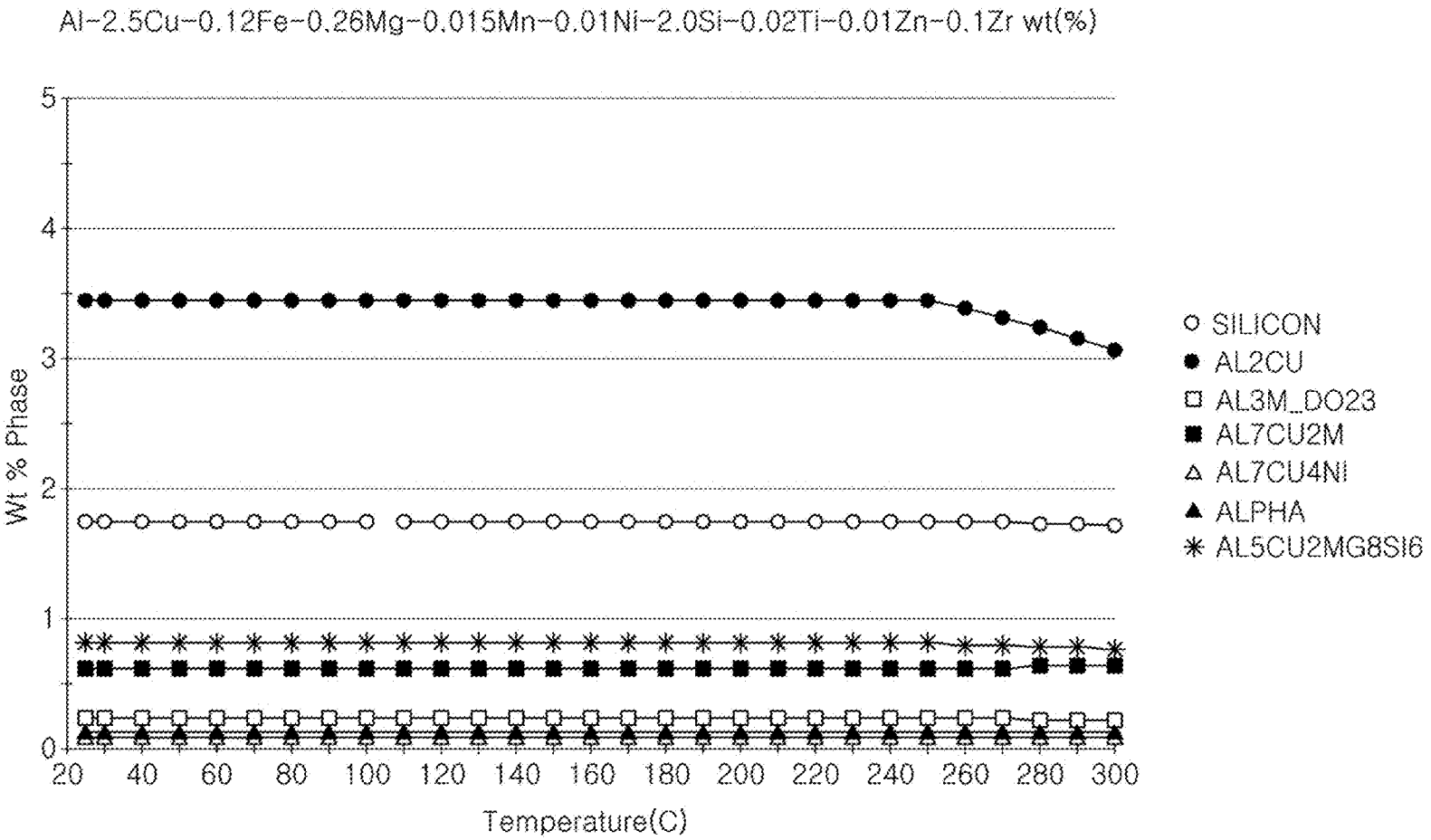
FIGS. 1 and 2 are graphs showing types and amounts of reinforcing phases of aluminum alloys formed at different temperatures according to Examples of the present invention.

Reference will now be made in detail to the embodiments of the present invention, examples of which are illustrated in the accompanying drawings. However, the present invention is not limited to the embodiments and implemented in various forms. The embodiments are provided only to fully illustrate the present invention and to completely inform those having ordinary knowledge in the art of the scope of the present invention.

Typical cylinder heads for gasoline engines have been produced by molding an AC2B alloy, which is an Al—Si—Cu-based alloy, using gravity casting and conducting T7 heat treatment.

The AC2B alloy includes 5.5 to 6.5% of Si, 1.0% of Fe, 3.0 to 4.0% of Cu, 0.6% of Mn, 0.1% of Mg, 0.35% of Ni, 1.0% of Zn, the balance of Al and inevitable impurities wherein percentage (%) is based on weight.

Regarding physical properties of the AC2B alloy having the composition described above, the AC2B alloy which has undergone T7 heat treatment exhibits yield strength of 220 MPa or more, tensile strength of 270 MPa or more, an elongation of 1.0% or more, and thermal conductivity of 160 W/mK@25° C. or 165 W/mK@200° C.

The AC2B alloy exhibits improved strength and castability via $Al_2Cu$ reinforcing phases and Si crystals (precipitates). However, when these crystals are excessively produced, thermal conductivity is reduced.

The cylinder head should maintain high strength and thermal conductivity in high temperature environments. However, typical AC2B alloys have sufficient strength, but may have of insufficient thermal conductivity.

Accordingly, there is a need for novel aluminum alloys which are capable of maintaining high thermal conductivity at a high temperature (200° C.) generated during operation of a cylinder while maintaining similar or superior strength to typical alloys.

Hereinafter, an aluminum alloy for a cylinder head according to embodiments of the present invention will be described with reference to the annexed drawings.

First, the aluminum alloy for a cylinder head includes the following ingredients based on wt %: 2 to 3% of Si; 2.5 to 3% of Cu; 0.01% or less (excluding 0%) of Zn; 0.15% or less (excluding 0%) of Fe; 0.02% or less (excluding 0%) of Mn; 0.1 to 0.3% of Mg; 0.01% or less (excluding 0%) of Ni; 0.02% or less (excluding 0%) of Ti; 0.1% or less (excluding 0%) of Zr; the balance of Al; and inevitable impurities.

In particular, the aluminum alloy for a cylinder head according to embodiments of the present invention forms 0.3 to 0.9% of an AlCuMgSi-based crystal and 3.3 to 4.0% of an $Al_2Cu$-based precipitate.

Next, the reason for limiting the amounts of respective ingredients to the ranges defined above will be described.

Si: 2 to 3%

Silicon (Si) is an element added to improve castability and, in embodiments, is added in an amount of 2% or more so as to secure castability and strength. When silicon (Si) is added in an amount generally exceeding 3% (not absolute), thermal conductivity at a high temperature is not improved to a desired level. Thus, in embodiments, the amount of silicon (Si) is limited to 3% or less.

Cu: 2.5 to 3%

Copper (Cu) is an element which forms $Al_2Cu$-based precipitates to improve strength of aluminum alloys. For this purpose, in embodiments, copper (Cu) is added in an amount of 2.5% or more. However, when copper (Cu) is added in an amount generally exceeding 3% (not absolute), strength is improved, but thermal conductivity may be disadvantageously deteriorated.

Zn: 0.01% or Less (Excluding 0%)

Zinc (Zn) is an element added to secure strength of materials. For this purpose, in embodiments, zinc (Zn) is preferably added in an amount of 0.01% or less.

Fe: 0.15% or Less (Excluding 0%)

Iron (Fe) is an element which is produced into an AlFeSi phase to improve strength and effectively prevent mold burning. However, when iron (Fe) is added in an amount generally exceeding 0.15% (not absolute), high-temperature thermal conductivity may be disadvantageously deteriorated due to increased proportion of an iron-based alloy.

Mn: 0.02% or Less (Excluding 0%)

Manganese (Mn) is an element which forms fine phases in tissues during aggregation to improve strength. However, when manganese (Mn) is excessively added, effects of other elements may be disadvantageously deteriorated. Thus, in embodiments, the maximum amount of manganese (Mn) is preferably limited to 0.02%.

Mg: 0.1 to 0.3%

Magnesium (Mg) is an element which forms $Mg_2Si$ reinforcing phases to improve strength. For this purpose, in embodiments, magnesium (Mg) is added in an amount of 0.1% or more. However, when magnesium (Mg) is added in an amount generally exceeding 0.3% (not absolute), thermal conductivity at a high temperature may be deteriorated due to increased crystal production.

Ni: 0.01% or Less (Excluding 0%)

Nickel (Ni) is an element which improves strength and castability. However, when nickel (Ni) is added in an amount exceeding 0.01%, high-temperature thermal conductivity is disadvantageously deteriorated.

Ti: 0.02% or Less (Excluding 0%)

Titanium (Ti) is an element which makes crystal particles fine to improve strength. However, when titanium (Ti) is added in an amount exceeding 0.02%, crystals are excessively produced and thermal conductivity at a high temperature is deteriorated.

Zr: 0.1% or Less (Excluding 0%)

Zirconium (Zr) is an element highly compatible with Al. When the content of zirconium (Zr) is limited to 0.1%, thermal conductivity can be improved, but when zirconium (Zr) is added in an amount exceeding 0.1%, elongation of materials is disadvantageously deteriorated due to increased amount of produced $Al_3Zr$.

Zinc (Zn) and magnesium (Mg) are elements added so as to secure strength. In embodiments, Zinc (Zn) is added in an amount within the range of 0.01% or less and magnesium (Mg) is added in an amount within the range of 0.1 to 0.3 wt %.

The residues of the aluminum alloy, excluding the aforementioned ingredients, are composed of aluminum (Al) and other inevitable impurities.

According to embodiments of the present invention, in order to produce a cylinder head with excellent thermal conductivity at a high temperature and strength, molten metals having a composition described above is produced by an ordinary method of producing a cylinder head. The ordinary method of producing a cylinder head is carried out by casting molten metals to produce a molded article and sequentially conducting solid solution treatment and then aging heat treatment on the molded article.

At this time, solid solution treatment is carried out at a heat treatment temperature of 265 to 275° C. for 2 to 3 hours. Preferably, solid solution treatment is carried out at a heat treatment temperature of 270° C. for 2 hours. As a result, the amounts of formed AlCuMgSi-based crystal and $Al_2Cu$-based precipitate are controlled within the ranges of 0.3 to 0.9% and 3.3 to 4.0%, respectively.

After aging heat treatment, an aluminum alloy which has thermal conductivity at 200° C. of 185 W/mK or more and tensile strength of 270 MPa or more, and exhibits excellent high-temperature thermal conductivity and strength, can be produced.

In embodiments, an aluminum alloy mass in the form or shape of a cylinder head includes 2 to 3% of Si, 2.5 to 3% of Cu, 0.01% or less of Zn, 0.15% or less of Fe, 0.02% or less of Mn, 0.1 to 0.3% of Mg, 0.01% or less of Ni, 0.02% or less of Ti, 0.1% or less of Zr and Al. In one embodiment, the aluminum alloy mass consist essentially of 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr and Al.

However, the invention is not limited to numerical ranges discussed above. In embodiments, Si is in an amount of 1.8, 1.9, 1.95, 2, 2.05, 2.08, 2.1, 2.15, 2.2, 2.3, 2.4, 2.45, 2.5, 2.6, 2.7, 2.8, 2.83, 2.9, 2.95, 3, 3.05, 3.1 and 3.2 wt %. In embodiments, the amount of Si is in a range formed by any two numbers selected from those listed in the proceeding sentence.

In embodiments, Cu is in an amount of 2.2, 2.3, 2.4, 2.45, 2.48, 2.5, 2.52, 2.55, 2.6, 2.65, 2.7, 2.75, 2.8, 2.83, 2.9, 2.95, 3, 3.05, 3.1 and 3.2 wt %. In embodiments, the amount of Cu is in a range formed by any two numbers selected from those listed in the proceeding sentence.

In embodiments, Mg is in an amount of 0.08, 0.09, 0.095, 0.098, 0.1, 0.102, 0.105, 0.108, 0.11, 0.15, 0.12, 0.125, 0.13, 0.14, 0.145, 0.15, 0.16, 0.17, 0.175, 0.18, 0.19, 0.2, 0.205, 0.21, 0.215, 0.22, 0.23, 0.24, 0.245, 0.25, 0.26, 0.27, 0.28, 0.29, 0.295, 0.3, 0.305, 0.31 and 0.32 wt %. In embodiments, the amount of Mg is in a range formed by any two numbers selected from those listed in the proceeding sentence.

In embodiments, the aluminum alloy mass includes an AlCuMgSi-based crystal in an amount ranging from 0.3 to 0.9% and an $Al_2Cu$-based precipitate in an amount ranging from 3.3 to 4.0% which are presented in an aluminum matrix.

However, the invention is not limited to numerical ranges discussed above. In embodiments, AlCuMgSi-based crystal is in an amount of 0.25, 0.26, 0.27, 0.28, 0.29, 0.295, 0.3, 0.302, 0.305, 0.31, 0.315, 0.32, 0.325, 0.33, 0.34, 0.36, 0.38, 0.39, 0.4, 0.43, 0.47, 0.5, 0.55, 0.57, 0.6, 0.63, 0.66, 0.68, 0.7, 0.75, 0.8, 0.82, 0.84, 0.88, 0.89, 0.91, 0.93, 0.95, 0.98 and 0.1 wt %. In embodiments, the amount of AlCuMgSi-based crystal is in a range formed by any two numbers selected from those listed in the proceeding sentence.

In embodiments, $Al_2Cu$-based precipitate is in an amount of 3.25, 3.26, 3.27, 3.28, 3.29, 3.295, 3.3, 3.302, 3.305, 3.31, 3.315, 3.32, 3.325, 3.33, 3.34, 3.36, 3.38, 3.39, 3.4, 3.43, 3.47, 3.5, 3.55, 3.57, 3.6, 3.63, 3.66, 3.68, 3.7, 3.75, 3.8, 3.82, 3.84, 3.88, 3.89, 3.9, 3.92, 3.94, 3.98, 3.99, 4.02, 4.05, 4.08 and 4.1 wt %. In embodiments, the amount of $Al_2Cu$-based precipitate is in a range formed by any two numbers selected from those listed in the proceeding sentence.

In embodiments, the AlCuMgSi-based crystal grains and the $Al_2Cu$-based precipitate are presented in the aluminum matrix. In one embodiment, the AlCuMgSi-based crystal includes $Al_5Cu_2Mg_8Si_6$. The $Al_2Cu$-based precipitate includes $Al_2Cu$.

In embodiments, for making a cylinder head, a molten composition is first provided. The molten composition includes 2 to 3% of Si, 2.5 to 3% of Cu, 0.01% or less of Zn, 0.15% or less of Fe, 0.02% or less of Mn, 0.1 to 0.3% of Mg, 0.01% or less of Ni, 0.02% or less of Ti, 0.1% or less of Zr, the balance of Al and inevitable impurities. The molten composition is molded to form an aluminum alloy mass. The molded aluminum alloy mass is heat-treated. In embodiments, the heat treatment includes placing the molded aluminum alloy mass in a furnace at a temperature of 265 to 275° C. for 2 to 3 hours. In embodiments, the heat-treated aluminum alloy mass includes an AlCuMgSi-based crystal in an amount ranging from 0.3 to 0.9% and an $Al_2Cu$-based precipitate in an amount ranging from 3.3 to 4.0% which are presented in an aluminum matrix. Machining the heat-treated aluminum alloy mass is performed to make the cylinder head. In embodiments, machining may be performed before the heat-treatment.

EXAMPLE

Hereinafter, the present invention will be described in more detail with reference to examples. These examples are provided only for illustration of the present invention and should be not construed as limiting the scope of the present invention.

The test of producing final products was conducted under production conditions of commercially available cylinder heads and articles cast using molten metals produced while changing contents of respective ingredients as shown in the following Table 1 were subjected to solid solution treatment and aging heat treatment. At this time, for a commercially available product, aging heat treatment was carried out by T7 heat treatment and, for other examples and comparative examples, heat treatment was carried out at 270° C. for 2 hours.

TABLE 1

| Items | Si | Cu | Zn | Fe | Mn | Mg | Ni | Ti | Zr | AlCuMgSi | $Al_2Cu$ |
|---|---|---|---|---|---|---|---|---|---|---|---|
| Commercially available product (AC2B-T7) | 6.5 | 3.2 | 0.004 | 0.17 | 0.015 | 0.1 | 0.006 | 0.02 | — | 0.3 | 4.8 |
| Example 1 | 2 | 2.5 | 0.01 | 0.12 | 0.015 | 0.26 | 0.01 | 0.02 | 0.1 | 0.81 | 3.45 |
| Example 2 | 3 | 2.8 | 0.01 | 0.14 | 0.016 | 0.28 | 0.01 | 0.02 | 0.1 | 0.87 | 3.99 |
| Comparative Example 1 | 6 | 2.8 | 0.01 | 0.15 | 0.02 | 0.28 | 0.01 | 0.02 | 0.1 | 0.95 | 4.3 |
| Comparative Example 2 | 1.5 | 2.8 | 0.01 | 0.15 | 0.02 | 0.28 | 0.01 | 0.02 | 0.1 | 0.94 | 4.2 |
| Comparative Example 3 | 3 | 3.5 | 0.01 | 0.15 | 0.02 | 0.28 | 0.01 | 0.02 | 0.1 | 0.94 | 5.2 |
| Comparative Example 4 | 3 | 2 | 0.01 | 0.15 | 0.02 | 0.28 | 0.01 | 0.02 | 0.1 | 0.94 | 2.4 |
| Comparative Example 5 | 3 | 2.8 | 0.01 | 0.15 | 0.02 | 0.09 | 0.01 | 0.02 | 0.1 | 0.26 | 3.1 |
| Comparative Example 6 | 3 | 2.8 | 0.01 | 0.15 | 0.02 | 0.5 | 0.01 | 0.02 | 0.1 | 1.6 | 3.1 |
| Comparative Example 7 | 3 | 2.8 | 0.01 | 0.15 | 0.02 | 0.28 | 0.01 | 0.02 | 0.2 | — | — |

Meanwhile, thermal conductivity of the cylinder head produced under the same conditions as above was measured at 25° C. and 200° C., and yield strength, tensile strength and elongation were measured at 25° C. Results are shown in the following Table 2.

TABLE 2

| Items | Thermal conductivity (W/mK@25° C.) | Thermal conductivity (W/mK@200° C.) | Yield strength (MPa) | Tensile strength (MPa) | Elongation (%) |
|---|---|---|---|---|---|
| Commercially available product (AC2B-T7) | 160 | 165 | 218 | 300 | 4 |
| Example 1 | 180 | 192 | 198 | 275 | 1.9 |
| Example 2 | 175 | 187 | 199 | 283 | 1.7 |
| Comparative Example 1 | 165 | 175 | 202 | 276 | 2 |
| Comparative Example 2 | 178 | 190 | 173 | 240 | 2.7 |
| Comparative Example 3 | 168 | 180 | 204 | 285 | 2.2 |
| Comparative Example 4 | 171 | 182 | 191 | 264 | 2.6 |
| Comparative Example 5 | 175 | 180 | 185 | 247 | 2.7 |
| Comparative Example 6 | 165 | 176 | 195 | 280 | 1.4 |
| Comparative Example 7 | 170 | 175 | 196 | 252 | 2.1 |

As can be seen from Tables 1 and 2, Examples 1 and 2 are groups which satisfy the composition of the aluminum alloy according to embodiments of the present invention, that is, a composition including 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr and the balance of Al and inevitable impurities, which maintain thermal conductivity of 185 W/mK or more at 200° C., yield strength of 197 MPa or more, tensile strength of 270 MPa or more and an elongation of 1.6 or more.

In addition, in Examples 1 and 2, AlCuMgSi-based crystals are formed in amounts of 0.81 wt % and 0.87 wt %, respectively, and $Al_2Cu$ precipitates are formed in amounts of 3.45 wt % and 3.99 wt %, respectively, so that desired levels of tensile strength and thermal conductivity at a high temperature can be obtained. Accordingly, AlCuMgSi-based crystals are preferably formed in amounts of 0.3 to 0.9% and $Al_2Cu$-based precipitates are preferably formed in amounts of 3.3 to 4.0%.

On the other hand, Comparative Example 2, which contains Si in an amount of less than a limit value, maintains a thermal conductivity of 185 W/mK or more at 200° C., but exhibits lower tensile strength than that of the commercially available product due to formation of more AlCuMgSi-based crystals than a limit value.

In addition, Comparative Example 3, which contains Cu in an amount exceeding a limit value, maintains a tensile strength of 270 MPa or more, but exhibits low thermal conductivity at 200° C. due to production of more $Al_2Cu$-based precipitates.

In addition, Comparative Example 6, which contains Mg in an amount exceeding a limit value, maintains a tensile strength of 270 MPa or more, but exhibits low thermal conductivity at 200° C. because AlCuMgSi-based crystals and $Al_2Cu$-based precipitates do not satisfy limit ranges.

Figure 2:
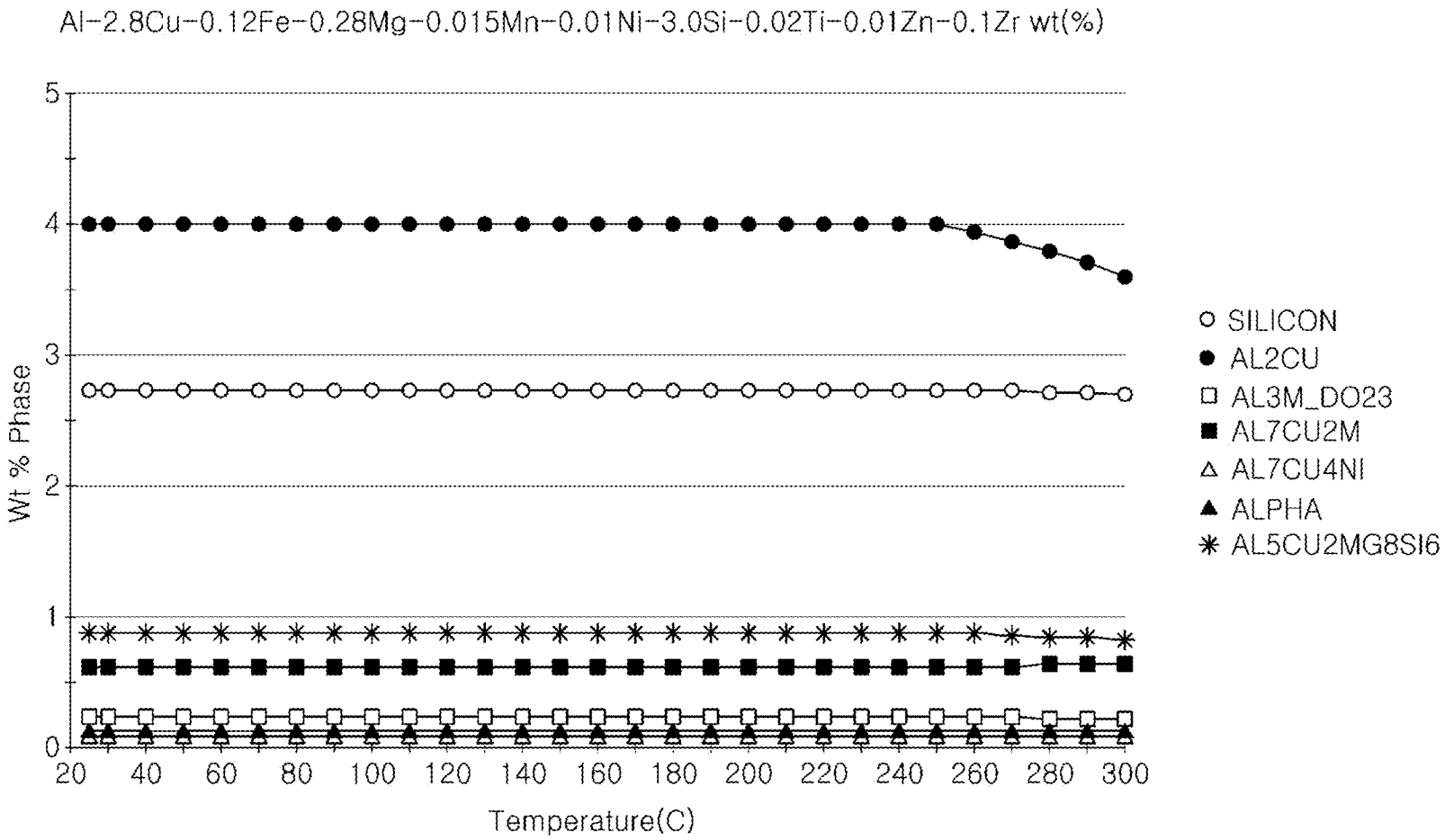

Meanwhile, FIGS. 1 and 2 are graphs showing types and amounts of reinforcing phases of aluminum alloys formed at different temperatures according to Examples of the present invention.

In FIGS. 1 and 2, AL5CU2MG8SI6 represents an AlCuMgSi-based crystal and AL2CU represents an $Al_2Cu$-based precipitate.

FIG. 1 is a graph showing types and amounts of reinforcing phases of aluminum alloys at different temperatures in Example 1. It can be seen that the AlCuMgSi-based crystal is formed in an amount of 0.81% and the $Al_2Cu$-based precipitate is formed in an amount of 3.45%.

FIG. 2 is a graph showing types and amounts of reinforcing phases of aluminum alloys at different temperatures in Example 2. It can be seen that the AlCuMgSi-based crystal is formed in an amount of 0.87% and the $Al_2Cu$-based precipitate is formed in an amount of 3.99%.

Figure 3A:
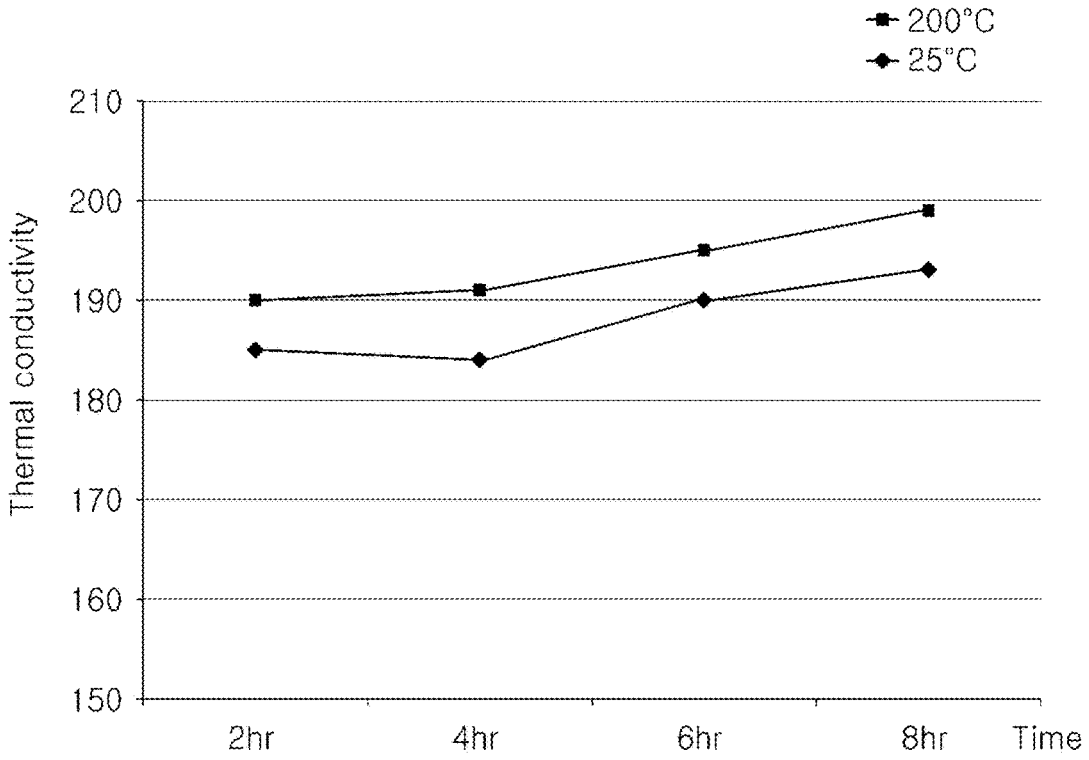
FIGS. 3A and 3B are graphs showing thermal conductivity changes of aluminum alloys according to Examples and a commercially available product, as a function of heat treatment time.
Figure 3B:
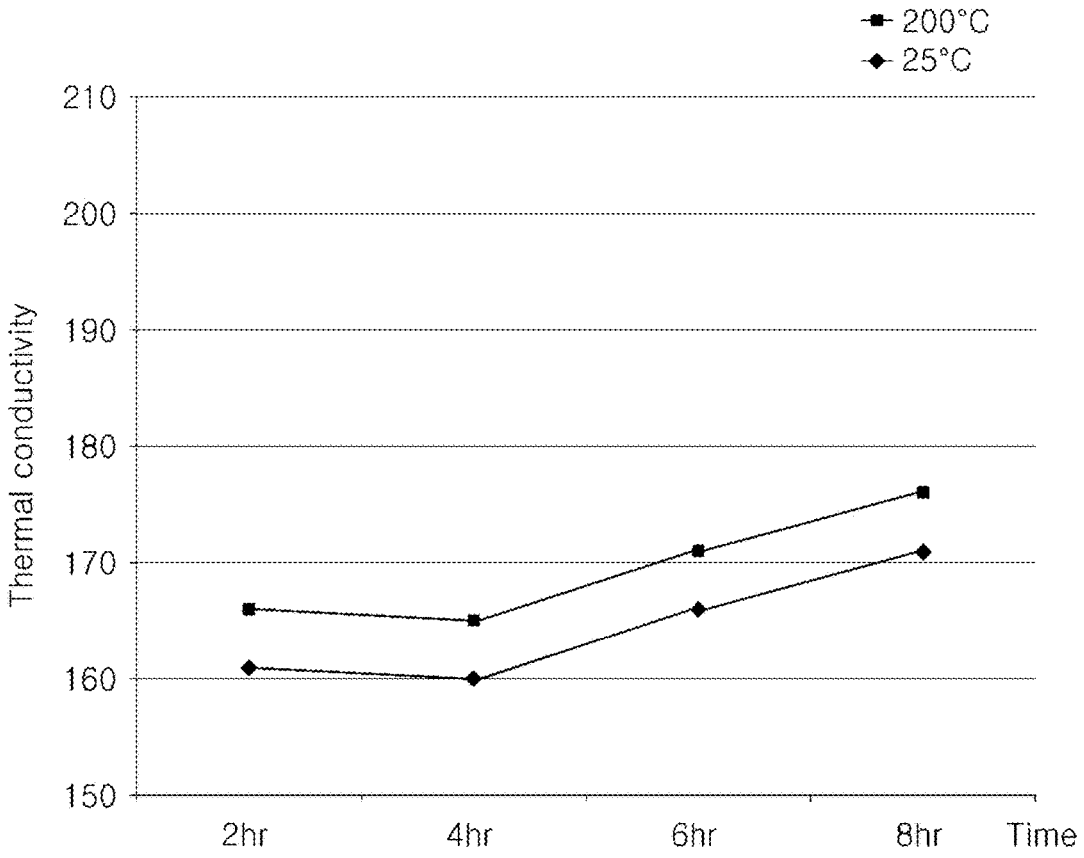

FIGS. 3A and 3B are graphs showing thermal conductivity changes of aluminum alloys according to Examples and a commercially available product, as a function of heat treatment time.

FIG. 3A is a graph showing thermal conductivity change of an aluminum alloy having an alloy composition defined in Example 1 at a constant heat treatment temperature of 270° C., as a function of heat treatment time. From FIG. 3A, it can be seen that, when aging heat treatment is conducted on the aluminum alloy having an alloy composition according to embodiments of the present invention at a heat treatment temperature of 270° C. for 2 hours or longer, thermal conductivity at 200° C. is maintained at 185 W/mK or more. In addition, it can be seen that, as heat treatment time increases, thermal conductivity slightly gradually increases.

FIG. 3B is a graph showing a thermal conductivity change of an aluminum alloy having an alloy composition of a commercially available product at a constant heat treatment temperature of 270° C., as a function of heat treatment time. From FIG. 3B, it can be seen that, although aging heat treatment is conducted on aluminum alloy of the commercially available product at a heat treatment temperature of 270° C. for hours or longer, thermal conductivity at 200° C. is not maintained at 185 W/mK or more.

Figure 4A:
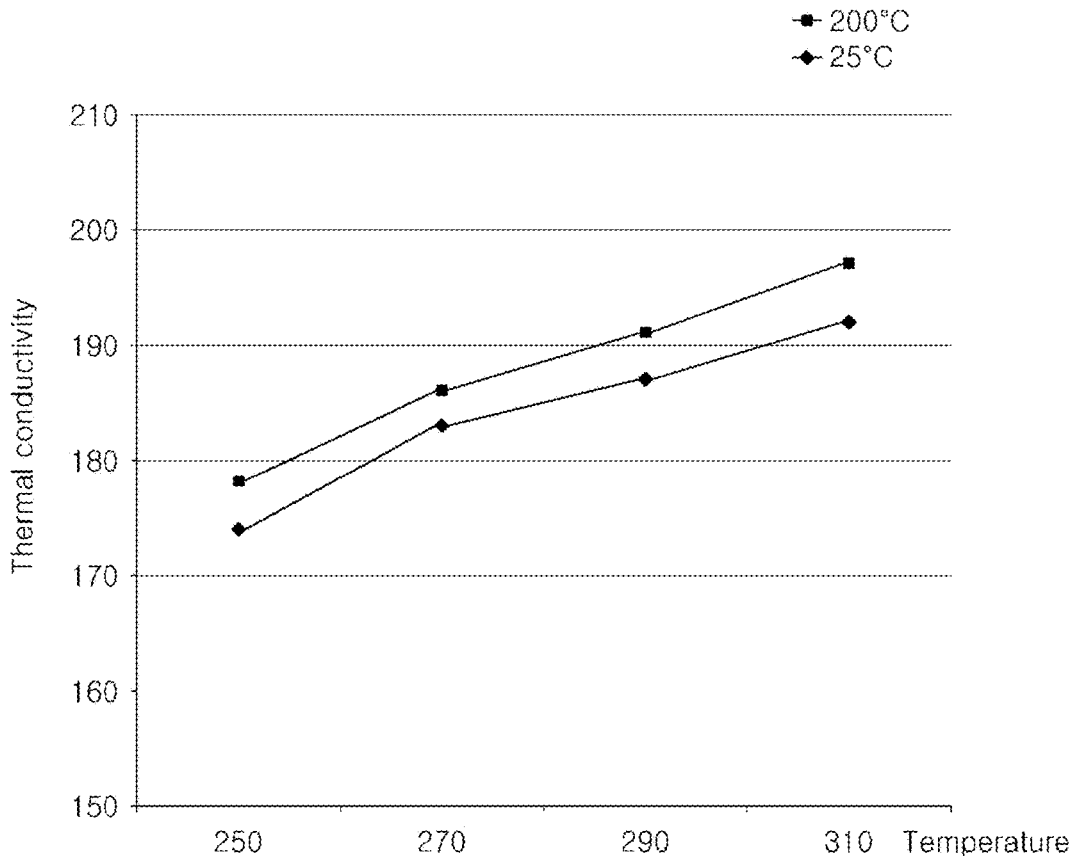
FIG. 4A and FIG. 4B are graphs showing thermal conductivity changes of aluminum alloys according to Examples and a commercially available product, as a function of heat treatment temperature.
Figure 4B:
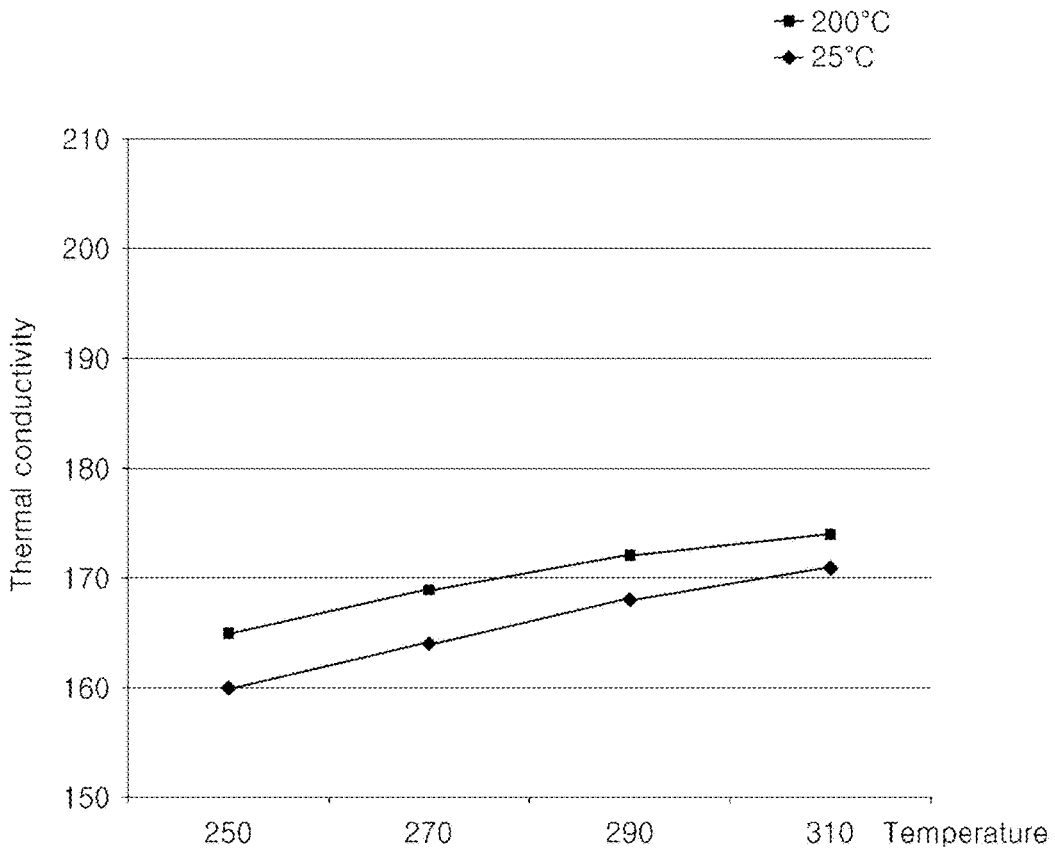

FIGS. 4A and 4B are graphs showing thermal conductivity changes of aluminum alloys according to Examples and Comparative Examples, as a function of heat treatment temperature.

FIG. 4A is a graph showing a thermal conductivity change of an aluminum alloy having an alloy composition defined in Example 1 for a constant heat treatment time of 2 hours, as a function of heat treatment temperature. From FIG. 4A, it can be seen that, when aging heat treatment is conducted on the aluminum alloy having an alloy composition according to embodiments of the present invention at a heat treatment temperature of 270° C. or higher for 2 hours, thermal conductivity at 200° C. is maintained at 185 W/mK or more. In addition, it can be seen that, as heat treatment time increases, thermal conductivity gradually increases.

FIG. 4B is a graph showing a thermal conductivity change of an aluminum alloy having an alloy composition of a commercially available product for a constant heat treatment time of 2 hours, as a function of heat treatment temperature. From FIG. 4B, it can be seen that, although aging heat treatment is conducted on aluminum alloy of the commercially available product at a heat treatment temperature of 270° C. or higher for 2 hours, thermal conductivity at 200° C. is not maintained at 185 W/mK or more.

Next, thermal conductivity changes of the aluminum alloy having an alloy composition in Example 1 were measured while changing heat treatment temperature and time. Results are shown in Table 3.

TABLE 3

| Heat treatment temperature (° C.) | Heat treatment time (hr) | Yield strength (MPa) | Tensile strength (MPa) | Elongation (%) |
|---|---|---|---|---|
| 250 | 2 | 197 | 272 | 2.5 |
| 270 | 4 | 173 | 237 | 3.6 |
| 270 | 2 | 198 | 275 | 1.9 |
| 290 | 2 | 148 | 213 | 4.8 |
| 310 | 2 | 120 | 198 | 6.2 |

As can be seen from Table 3, when heat treatment time is longer than the limit value defined in embodiments of the present invention, although heat treatment temperature is higher than or within the limit value defined in embodiments of the present invention, tensile strength cannot be maintained at a desired level (270 MPa or more).

As is apparent from the above description, the aluminum alloy for a cylinder head and the method of producing a cylinder head using the same according to embodiments of the present invention have the following effects.

First, the aluminum alloy maintains excellent thermal conductivity at high temperatures formed during operation of a cylinder so that a knocking phenomenon can be prevented.

Second, the aluminum alloy maintains similar or superior strength to typical aluminum alloys and is thus useful for cylinder heads.

Although embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An aluminum alloy for a cylinder head used in a vehicle engine comprising:

2 to 3% of Si;
2.5 to 3% of Cu;
0.01% or less (excluding 0%) of Zn;
0.15% or less (excluding 0%) of Fe;
0.02% or less (excluding 0%) of Mn;
0.1 to 0.3% of Mg;
0.01% or less (excluding 0%) of Ni;
0.02% or less (excluding 0%) of Ti;
0.1% or less (excluding 0%) of Zr;
the balance of Al; and
inevitable impurities,
wherein an AlCuMgSi-based crystal is formed in an amount ranging from 0.3 to 0.9% and an $Al_2Cu$-based precipitate is formed in an amount ranging from 3.3 to 4.0%,
wherein percentage (%) is based on weight.

2. The aluminum alloy according to claim 1, wherein the aluminum alloy has a thermal conductivity at 200° C. of 185 W/mK or more.

3. The aluminum alloy according to claim 1, wherein the aluminum alloy has a tensile strength of 270 MPa or more.

4. The aluminum alloy according to claim 1, wherein the aluminum alloy has a yield strength of 197 MPa or more and an elongation of 1.6% or more.

5. A method of producing an aluminum alloy for a cylinder head used in a vehicle engine comprising:

casting molten composition comprising 2 to 3% of Si, 2.5 to 3% of Cu, 0.01% or less (excluding 0%) of Zn, 0.15% or less (excluding 0%) of Fe, 0.02% or less (excluding 0%) of Mn, 0.1 to 0.3% of Mg, 0.01% or less (excluding 0%) of Ni, 0.02% or less (excluding 0%) of Ti, 0.1% or less (excluding 0%) of Zr, the balance of Al and inevitable impurities to produce an article in the form of a cylinder head; and
conducting solid solution treatment on the article and conducting aging heat treatment such that an AlCuMgSi-based crystal is formed in an amount of 0.3 to 0.9% and an $Al_2Cu$-based precipitate is formed in an amount of 3.3 to 4.0%,
wherein percentage (%) is based on weight.

6. The method according to claim 5, wherein the aging heat treatment is carried out at a heat treatment temperature of 265 to 275° C. for 2 to 3 hours.

* * * * *